United States Patent [19]

Ray et al.

[11] 4,134,779

[45] Jan. 16, 1979

[54] IRON-BORON SOLID SOLUTION ALLOYS HAVING HIGH SATURATION MAGNETIZATION

[75] Inventors: Ranjan Ray, Randolph; Ryusuke Hasegawa, Morristown, both of N.J.

[73] Assignee: Allied Chemical Corporation, Morris Township, Morris County, N.J.

[21] Appl. No.: 808,589

[22] Filed: Jun. 21, 1977

[51] Int. Cl.[2] ..... C22C 38/00

[52] U.S. Cl. ..... 148/121; 75/123 B; 148/31.55

[58] Field of Search ..... 75/123 B, 122, 129; 148/121, 122, 31.55

[56] References Cited

U.S. PATENT DOCUMENTS

| | | | |
|---|---|---|---|
| 1,562,043 | 11/1925 | Pacz | 75/123 B |
| 3,862,658 | 1/1975 | Bedell | 264/176 F |
| 3,863,700 | 2/1975 | Bedell et al. | 264/176 F |
| 3,871,836 | 3/1975 | Polk et al. | 75/122 |
| 4,036,638 | 7/1977 | Ray et al. | 75/123 B |

OTHER PUBLICATIONS

Ruhl, R. et al.; *Splat Quenching Fe-Ni-B Alloys,* in *Trans. AIME.,* 245, Feb. 1969, pp. 253-257.

Hansen, M.; *Constitution of Binary Alloys;* New York, 1958, pp. 249-252.

*Primary Examiner*—Arthur J. Steiner

*Attorney, Agent, or Firm*—Ernest D. Buff; Gerhard H. Fuchs

[57] ABSTRACT

Ferromagnetic substitutional solid solution alloys characterized by high saturation magnetization and having a bcc structure are provided. The alloys consist essentially of about 4 to 12 atom percent boron, balance essentially iron plus incidental impurities.

6 Claims, No Drawings

IRON-BORON SOLID SOLUTION ALLOYS HAVING HIGH SATURATION MAGNETIZATION

BACKGROUND OF THE INVENTION

1. Field of the Invention

This invention relates to ferromagnetic alloys characterized by a high saturation magnetization, and, in particular, to iron-boron solid solution alloys having a body centered cubic (bcc) structure.

2. Description of the Prior Art

The equilibrium solid solubilities of boron in α-Fe (ferrite) and γ-Fe (austenite) are quite small, being less than 0.05 and 0.11 atom percent, respectively; see M. Hansen et al., *Constitution of Binary Alloys*, pp. 249–252, McGraw-Hill Book Co., Inc. (1958). Attempts have been made to increase the solubility of boron in iron by a splat-quenching technique, without success; see, e.g., R. C. Ruhl et al., Vol. 245, *Transactions of the Metallurgical Society of AIME*, pp. 253–257 (1969). The splat-quenching employed gun techniques and resulted only in the formation of ferrite and $Fe_3B$, with no changes in the amount of austenitic phase. Compositions containing 1.6 and 3.2 wt.% (7.7 and 14.5 at.%, respectively) boron were prepared. These splat-quenched materials, as well as equilibrium alloys which contain two phases, are very brittle and cannot easily be processed into thin ribbons or strips for use in commercial applications.

SUMMARY OF THE INVENTION

In accordance with the invention, iron-boron solid solution alloys having high saturation magnetization are provided which consist essentially of about 4 to 12 atom percent boron, balance essentially iron plus incidental impurities. The alloys of the invention possess a bcc structure and are totally substitutional across the range of about 4 to 12 atom percent of boron.

The alloys of the invention are advantageously easily fabricated as continuous filament with good bend ductility by a process which comprises (a) forming a melt of the material;

(b) depositing the melt on a rapidly rotating quench surface; and (c) quenching the melt at a rate of about $10^4$ to $10^{6\circ}$ C./sec to form the continuous filament.

The alloys of the invention possess moderately high hardness and strength, good corrosion resistance, high saturation magnetization and high thermal stability. The alloys in the invention find use in, for example, magnetic cores requiring high saturation magnetization.

DETAILED DESCRIPTION OF THE INVENTION

The compositions of alloys within the scope of the invention are listed in Table I, together with their equilibrium structures and the phases retained upon rapid quenching to room temperature. X-ray difraction analysis reveals that a single metastable phase α-Fe(B) with bcc structure is retained in the chill cast ribbons. Table I also summarizes the change of lattice parameter and density with respect to boron concentration. It is clear that the lattice contracts with the addition of boron, thus indicating a predominate dissolution of small boron atoms on the substitutional sites of the α-Fe lattice. This is further supported by the number of atoms in the unit cell (calculated from the density and lattice parameters) in the solid solution as listed in Table I. The number of atoms per cell remains essentially constant at 2 (within experimental error) irrespective of the solute concentration. As is well-known, this is characteristic of a substitutional solid solution. For comparison, pure Fe exists in the α-phase (equilibrium) at room temperature and has an average density of 7.87 g/cm$^3$, a lattice parameter of 2.8664 and 2.0 atoms per unit cell. It should be noted that neither the mixture of the equilibrium phases of α-Fe and $Fe_2B$ expected from the Fe-B phase diagram nor the orthorhombic $Fe_3B$ phase previously obtained by splat-quenching are formed by the alloys of the invention.

Table I

Results of X-ray Analysis and Density Measurements on Fe(B) Chill Cast Ribbons

| Alloy Composition (at. %) | Equilibrium Phases at Room Temp.[c] | Phases Present after Chill Casting | Average Density, g/cm$^3$ | Lattice Parameter[a] (A) | Number of Atoms in Unit Cell |
|---|---|---|---|---|---|
| $Fe_{96}B_4$ | α-Fe + $Fe_2B$ | α-Fe(B) solid soln.[b] | 7.74 | 2.864 | 2.03 |
| $Fe_{94}B_6$ | α-Fe + $Fe_2B$ | α-Fe(B)s.s. | 7.74 | 2.863 | 2.06 |
| $Fe_{92}B_8$ | α-Fe + $Fe_2B$ | α-Fe(B)s.s. | 7.73 | 2.861 | 2.09 |
| $Fe_{88}B$ 12 | α-Fe + $Fe_2B$ | α-Fe(B)s.s. | 7.55 | 2.855 | 2.10 |

[a]Estimated maximum fractional error = ± .001 A.
[b]Metastable solid solutions α-Fe(B) is of the W-A2 type.
[c]Hansen et al., Constitution of Binary Alloys The amount of boron in the compositions of the invention is constrained by two considerations. The upper limit of about 12 atom percent is dictated by the cooling rate. At the cooling rates employed herein of about $10^4$ to $10^{6\circ}$ C./sec, compositions containing more than about 12 atom percent (2.6 weight percent) boron are formed in a substantially glassy phase, rather than the bcc solid solution phase obtained for compositions of the invention. The lower limit of about 4 atom percent is dictated by the fluidity of the molten composition. Compositions containing less than about 4 atom percent (0.8 weight percent) boron do not have the requisite fluidity for melt spinning into filaments. The presence of boron increases the fluidity of the melt and hence the fabricability of filaments.

Table II lists the hardness, the ultimate tensile strength and the temperature at which the metastable alloy transforms into a stable crystalline state. Over the range of 4 to 12 atom percent boron, the hardness ranges from 425 to 919 kg/mm$^2$, the ultimate tensile strength ranges from 206 to 360 ksi and the transformation temperature ranges from 880 to 770 K.

Table II

Mechanical Properties of Melt Spun Fe(B) bcc Solid Solution Ribbon

| Alloy Composition (at. %) | Hardness (kg/mm$^2$) | Ultimate Tensile Strength (ksi) | Transformation Temperature (K) |
|---|---|---|---|
| $Fe_{96}B_4$ | 425 | 206 | 880 |

Table II-continued

| Mechanical Properties of Melt Spun Fe(B) bcc Solid Solution Ribbon | | | |
|---|---|---|---|
| Alloy Composition (at. %) | Hardness ($kg/mm^2$) | Ultimate Tensile Strength (ksi) | Transformation Temperature (K) |
| $Fe_{94}B_6$ | 557 | 242 | 860 |
| $Fe_{92}B_8$ | 698 | 280 | 820 |
| $Fe_{90}B_{10}$ | 750 | 305 | 795 |
| $Fe_{88}B_{12}$ | 919 | 360 | 770 |

At the transformation temperature, a progressive transformation to a mixture of stable phases, substantially pure α-Fe and tetragonal $Fe_2B$, occurs. The high transformation temperatures of the alloys of the invention are indicative of their high thermal stability.

The room temperature saturation magnetization ($B_s$) of these alloys ranges from 16.6 kGauss for $Fe_{88}B_{12}$ to 20.0 kGauss for $Fe_{96}B_4$. Further magnetic properties of the alloys of the invention are listed in Table III. These include the saturation moments in Bohr magneton per Fe atom and the Curie temperatures. For comparison, the saturation moment of pure iron (α-Fe) is 2.22 $\mu_B$ and its Curie temperature is 1043 K.

Table III

| Results of Magnetic Measurements on Crystalline $Fe_{100-x}B_x$ Alloys of the Invention. | | |
|---|---|---|
| Boron Content x (at.%) | Saturation Moment ($\mu_B$/Fe atom) | Curie Temperature (K) |
| 4 | 2.19 | 978 |
| 6 | 2.17 | 964 |
| 8 | 2.15 | 944 |
| 10 | 2.13 | 916 |
| 12 | 2.10 | 878 |

Alloys consisting essentially of about 4 to 6 atom percent boron, balance iron, have $B_s$ values comparable to the grain-oriented Fe-Si transformer alloys ($B_s$ = 19.7 kGauss). Further, alloys in this range are ductile. Thus, these alloys are useful in transformer cores and are accordingly preferred.

The alloys of the invention are advantageously fabricated as continuous filaments. The term "filament" as used herein includes any slender body whose transverse dimensions are much smaller than its length, examples of which include ribbon, wire, strip, sheet and the like having a regular or irregular cross-section.

The alloys of the invention are formed by cooling an alloy melt of the appropriate composition at a rate of about $10^4$ to $10^{6°}$ C./sec. Cooling rates less than about $10^{4°}$ C./sec result in mixtures of well-known equilibrium phases of α-Fe and $Fe_2B$. Cooling rates greater than about $10^{6°}$ C./sec result in the metastable orthorhombic $Fe_3B$ phase and/or glassy phases. Cooling rates of at least about $10^{5°}$ C./sec easily provide the bcc solid solution phase and are accordingly preferred. A variety of techniques are available for fabricating rapidly quenched continuous ribbon, wire, sheet, etc. Typically, a particular composition is selected, powders of the requisite elements in the desired proportions are melted and homogenized and the molten alloy is rapidly quenched by depositing the melt on a chill surface such as a rapidly rotating cylinder. The melt may be deposited by a variety of methods, exemplary of which include melt spinning processes, such as taught in U.S. Pat. No. 3,862,658, melt drag processes, such as taught in U.S. Pat. No. 3,522,836, and melt extraction processes, such as taught in U.S. Pat. No. 3,863,700, and the like. The alloys may be formed in air or in moderate vacuum. Other atmospheric conditions such as inert gases may also be employed.

EXAMPLES

Alloys were prepared from constituent elements (purity higher than 99.9%) and were rapidly quenched from the melt in the form of continuous ribbons. Typical cross-sectional dimensions of the ribbons were 1.5 mm by 40 μm. Densities were determined by comparing the specimen weight in air and bromoform ($CBr_4$, $\rho$ = 2.865 $g/cm^3$) at room temperature. X-ray diffraction patterns were taken with filtered copper radiation in a Norelco diffractometer. The spectrometer was calibrated to a silicon standard with the maximum error in lattice parameter estimated to be ±0.001 Å. The thermomagnetization data were taken by a vibrating sample magnetometer in the temperature range between 4.2 and 1050 K. Hardness was measured by the diamond pyramid technique, using a Vickers-type indenter consisting of a diamond in the form of a square-based pyramid with an included angle of 136° between opposite faces. Loads of 100 g were applied. The results of the measurements are summarized in Tables I, II and III.

What is claimed is:

1. A ferromagnetic material, having a saturation magnetization ranging from 16.6 to 20.0 k Gauss, a hardness ranging from 425 to 919 $kg/mm^2$ and an ultimate tensile strength ranging from 206 to 360 ksi and having a single phase formed in body centered cubic structure, consisting essentially of about 4 to 12 atom percent boron, balance essentially iron plus incidental impurities.

2. The ferromagnetic material of claim 1 consisting essentially of about 4 to 6 atom percent boron, balance essentially iron plus incidental impurities.

3. The ferromagnetic material of claim 1 in the form of substantially continuous filaments.

4. A process for fabricating substantially continuous filaments of a ferromagnetic material, having a saturation magnetization ranging from 16.6 to 20.0 k Gauss, a hardness ranging from 425 to 919 $kg/mm^2$ and an ultimate tensile strength from 206 to 306 ksi and having a single phase formed in body centered cubic structure, consisting essentially of about 4 to 12 atom percent boron, balance essentially iron plus incidental impurities, which comprises (a) forming a melt of the material;

(b) depositing the melt on a rapidly rotating quench surface; and (c) quenching the melt at a rate of about $10^4$ to $10^{6°}$ C./sec to form the continuous filament.

5. The process of claim 4 in which the quench rate is at least about $10^{5°}$ C./sec.

6. The process of claim 4 in which the ferromagnetic material consists essentially of about 4 to 6 atom percent boron, balance essentially iron plus incidental impurities.

* * * * *